US010509347B2

(12) United States Patent
Mizutani

(10) Patent No.: US 10,509,347 B2
(45) Date of Patent: Dec. 17, 2019

(54) IMAGE PROCESSING APPARATUS AND IMAGE PROCESSING METHOD

(71) Applicants: KABUSHIKI KAISHA TOSHIBA, Tokyo (JP); TOSHIBA TEC KABUSHIKI KAISHA, Tokyo (JP)

(72) Inventor: Kikuo Mizutani, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 87 days.

(21) Appl. No.: 15/681,658

(22) Filed: Aug. 21, 2017

(65) Prior Publication Data

US 2018/0067424 A1 Mar. 8, 2018

(30) Foreign Application Priority Data

Sep. 2, 2016 (JP) ..... 2016-171781

(51) Int. Cl.

| | |
|---|---|
| ***G03G 15/20*** | (2006.01) |
| ***B41M 7/00*** | (2006.01) |
| ***G03G 15/00*** | (2006.01) |
| ***G03G 21/00*** | (2006.01) |
| *G03G 21/20* | (2006.01) |

(52) U.S. Cl.

CPC ..... *G03G 15/205* (2013.01); *B41M 7/0009* (2013.01); *G03G 15/6582* (2013.01); *G03G 21/00* (2013.01); *G03G 21/20* (2013.01); *G03G 2215/00383* (2013.01); *G03G 2215/00666* (2013.01); *G03G 2215/00759* (2013.01)

(58) Field of Classification Search

CPC ..... G03G 15/205; G03G 21/00; G03G 21/20; G03G 2215/00383; G03G 2215/00666; G03G 2215/00759; G03G 15/6582; B41M 7/0009

See application file for complete search history.

(56) References Cited

U.S. PATENT DOCUMENTS 4,873,441 A * 10/1989 Kimura ..... G03B 42/02 250/588
5,028,785 A * 7/1991 Kimura ..... G01T 1/2014 250/588
6,329,317 B1 * 12/2001 Takayama ..... G03G 9/0928 503/201
8,614,725 B2 * 12/2013 Ishii ..... B41J 2/32 347/179
8,922,608 B2 * 12/2014 Mizutani ..... B41M 7/0009 347/179
9,128,450 B2 * 9/2015 Terada ..... G03G 15/6585

(Continued)

FOREIGN PATENT DOCUMENTS

JP H09-44042 2/1997

*Primary Examiner* — David H Banh
(74) *Attorney, Agent, or Firm* — Kim & Stewart LLP

(57) ABSTRACT

According to an embodiment, an image processing apparatus includes a detector, a heater, and a controller. The detector detects an image formed on a sheet. The heater applies a predetermined heat amount onto the sheet to carry out erasing processing on the sheet. The controller controls, based on a detection result of the detector, the number of times the erasing processing is to be carried out on the sheet and a heat amount to be applied onto the sheet in the erasing processing.

14 Claims, 5 Drawing Sheets

(56) References Cited

U.S. PATENT DOCUMENTS

| | | | | |
|---|---|---|---|---|
| 2005/0191082 | A1* | 9/2005 | Takayama | B41J 29/26 399/101 |
| 2010/0021840 | A1* | 1/2010 | Sano | C09D 11/32 430/113 |
| 2010/0315475 | A1* | 12/2010 | Taki | B41J 2/32 347/179 |
| 2012/0056962 | A1* | 3/2012 | Takayama | B41J 2/32 347/179 |
| 2013/0002782 | A1* | 1/2013 | Kawaguchi | G03G 15/6585 347/179 |
| 2014/0093293 | A1* | 4/2014 | Yamaguchi | G03G 21/00 399/341 |
| 2014/0213443 | A1* | 7/2014 | Iguchi | B41M 5/305 503/201 |
| 2016/0067999 | A1* | 3/2016 | Hiyoshi | B41M 7/0009 347/179 |
| 2016/0068000 | A1* | 3/2016 | Fukuhara | B41M 7/0009 347/179 |

* cited by examiner

IMAGE PROCESSING APPARATUS AND IMAGE PROCESSING METHOD

CROSS-REFERENCE TO RELATED APPLICATION

This application is based upon and claims the benefit of priority from the prior Japanese Patent Application No. 2016-171781, filed on Sep. 2, 2016, the entire contents of which are incorporated herein by reference.

FIELD

An embodiment described herein generally relates to an image processing apparatus including a function of erasing an image formed on a sheet by heating, and an image processing method.

BACKGROUND

From the past, there has been an apparatus that carries out, on an image formed on a sheet, processing of erasing the image by applying heat (hereinafter, referred to as erasing processing). This apparatus of the past carries out the erasing processing by heating from one surface of the sheet. The apparatus of the past has changed the number of times the erasing processing is carried out on the basis of whether a sheet surface to be subjected to the erasing processing is one surface or both surfaces.

However, in the apparatus of the past, an increase of a time required until the erasing processing is completed and an increase of power consumption have been induced in some cases.

DETAILED DESCRIPTION

According to one embodiment, an image processing apparatus includes a detector, a heater, and a controller. The detector detects an image formed on a sheet. The heater applies a predetermined heat amount onto the sheet to carry out erasing processing on the sheet. The controller controls, based on a detection result of the detector, the number of times the erasing processing is to be carried out on the sheet and a heat amount to be applied onto the sheet in the erasing processing.

Hereinafter, embodiments for embodying the present invention will be described with reference to the drawings. In the figures, the same symbols denote the same or similar parts.

First Embodiment

In this embodiment, an image forming apparatus including an erasing function will be taken as an example of an image processing apparatus.

An image forming apparatus 1 is an MFP (Multifunction Peripheral) that is capable of forming an image (toner image) on a sheet and includes a function of erasing the image formed on the sheet. The erasing used herein means visually making an image formed in colors different from a base color of a sheet (including not only chromatic colors but also achromatic colors such as white and black) disappear.

Figure 1:
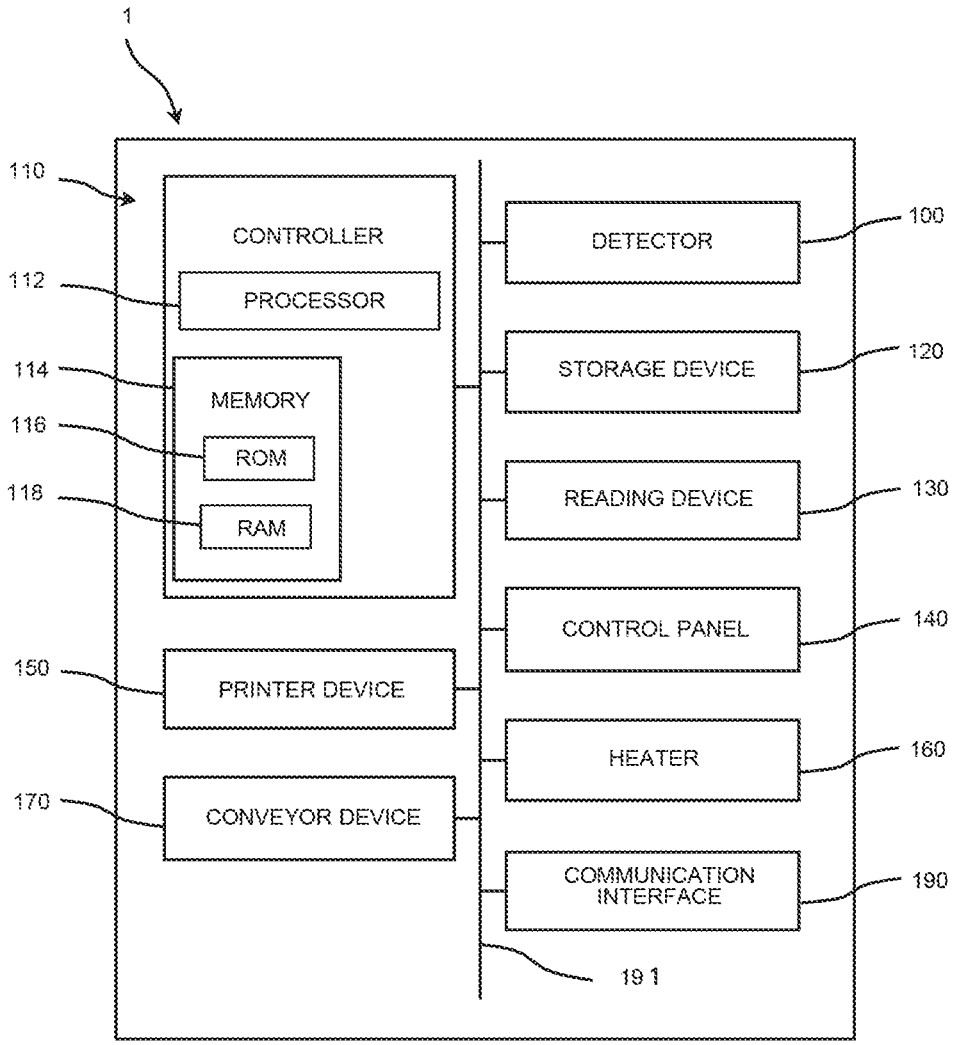
FIG. 1 is a block diagram showing an image processing apparatus according to a first embodiment.

FIG. 1 is a control block diagram showing a hardware configuration of the image forming apparatus 1.

The image forming apparatus 1 includes a detector 100, a controller 110, a storage device 120, a reading device 130, a control panel 140, a printer device 150, a heater 160, a conveyor device 170, and a communication interface (I/F) 190. The respective units of the image forming apparatus 1 are mutually connected via a bus line 191.

The detector 100 detects whether an image is formed on each of both surfaces of a sheet that is to be subjected to erasing processing. The detector 100 includes, for example, two CCD image sensors (Charge Coupled Device Image Sensors; hereinafter, abbreviated to CCD) 102 and 104 shown in FIG. 2. The CCD 102 as one of the CCDs photographs one of the surfaces of the sheet, and the other CCD 104 photographs the other surface of the sheet. The controller 110 to be described later uses image data output from the CCDs 102 and 104 to determine which surface of the sheet an image is formed on.

It should be noted that although the CCD is taken as an example of the detector 100 herein, a line sensor may be used instead.

The controller 110 includes a processor 112 and a memory 114. The processor 112 includes a CPU (Central Processing Unit) or an MPU (Micro Processing Unit). The memory 114 is, for example, a semiconductor memory, and includes a ROM (Read Only Memory) 116 that stores various control programs and a RAM (Random Access Memory) 118 that provides a temporary working area to the processor 112. For example, the ROM 116 stores a printing rate of a sheet, which is a threshold value for determining whether an image is formed on the sheet, and the like. The RAM 118 may temporarily store an image read by the detector 100. The controller 110 controls the respective units of the image forming apparatus 1 based on various programs stored in the ROM 116 or the storage device 120 to be described later.

The storage device 120 stores an image read by the detector 100. The storage device 120 may be, for example, a hard disk drive, other magnetic storage apparatuses, an optical storage apparatus, a semiconductor storage apparatus such as a flash memory, or an arbitrary combination of these. For example, the controller 110 stores an image of a sheet read by the detector 100 in the storage device 120. Accordingly, in a case where image data erased by erasing processing becomes necessary later, a user can acquire the image data from the storage device 120.

The reading device 130 is a scanner that reads an image of a target sheet, for example. The reading device 130 outputs read image information as image data. This image data is stored in the storage device 120 as described above. Further, the image data stored in the storage device 120 may be transmitted to other information processing apparatuses via a network. Moreover, the printer device 150 to be described later may form an image on another sheet based on the image data stored in the storage device 120.

The control panel 140 includes a display and an operation unit. The display is a display apparatus such as a liquid crystal display and an organic EL (Electro Luminescence) display. The display displays various types of information related to the image forming apparatus 1. The control panel 140 includes a plurality of buttons as the operation unit. The operation unit receives user operations. The operation unit outputs signals corresponding to operations made by the user to the controller 110. It should be noted that the display and the operation unit may be configured as an integrated touch panel.

The printer device 150 forms an image on a front surface of a sheet using a toner, for example. The toner in this embodiment includes a toner as an unerasable recording agent (hereinafter, referred to as "normal toner") and a toner as an erasable recording agent (hereinafter, referred to as "erasing toner"). The normal toner is a toner for colors of yellow (Y), magenta (M), cyan (C), black (K), and the like, for example. The erasing toner is a color toner similar to the normal toner and is, for example, blue. The erasing toner is erased by being heated at a temperature higher than a temperature at which the normal toner is fixed to a sheet.

The heater 160 includes a heating roller 162 and a pressure roller 164. The heating roller 162 applies heat to a sheet from a first surface side of the sheet. The pressure roller 164 applies pressure to the sheet from a second surface side of the sheet. By this heating and pressurization, the heater 160 fixes a toner image transferred onto the sheet during image formation and erases the image on the sheet during image erasing.

It should be noted that the first surface of a sheet in this embodiment refers to an upper surface (hereinafter, referred to as front surface) of a sheet accommodated in a sheet feeder device 200 shown in FIG. 2, and the second surface of a sheet refers to a lower surface (hereinafter, referred to as back surface) of a sheet accommodated in the sheet feeder device 200.

Figure 2:
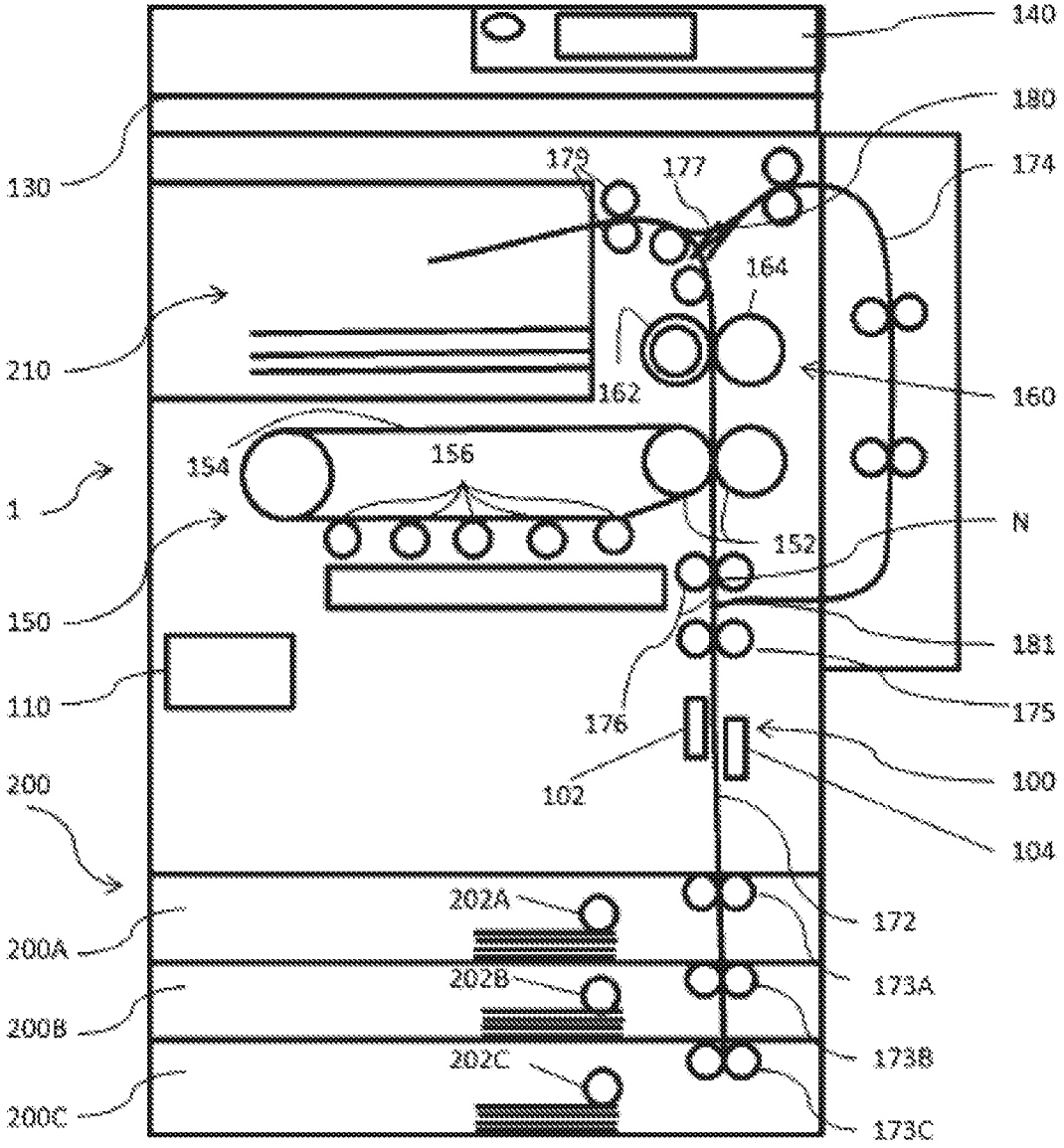
FIG. 2 is a cross-sectional diagram showing the image processing apparatus according to the first embodiment.

The conveyor device 170 includes a first conveyor path 172 and a second conveyor path 174 shown in FIG. 2. The conveyor device 170 also includes a plurality of rollers arranged on the first conveyor path 172 and the second conveyor path 174 and a plurality of conveyor motors for driving the respective motors.

The communication I/F 190 is an interface for connecting with an external apparatus. The communication I/F 190 communicates with external apparatuses on a network via appropriate wireless or wired communication using, for example, Bluetooth (registered trademark), IEEE802.15, IEEE802.11, IEEE802.3, and IEEE3304 for infrared connections and optical connections, and the like. The communication I/F 190 may further include a USB connection portion to which a USB-standard connection terminal is connected, a parallel interface, and the like. The controller 110 communicates with an MFP and other external apparatuses via the communication I/F 190.

FIG. 2 is a cross-sectional diagram showing the image forming apparatus 1 described with reference to FIG. 1.

The sheet feeder device 200 is provided at a lower portion of a casing. The sheet feeder device 200 includes a plurality of sheet feeder cassettes 200A, 200B, and 200C. The sheet feeder cassettes 200A, 200B, and 200C respectively accommodate sheets of predetermined sizes and types. It should be noted that settings of the sheet feeder cassettes 200A, 200B, and 200C can be changed as appropriate. The sheet feeder cassettes 200A, 200B, and 200C include pickup rollers 202A, 202B, and 202C, respectively. The pickup rollers 202A, 202B, and 202C take out the sheets one by one from the sheet feeder cassettes 200A, 200B, and 200C, respectively. The pickup rollers 202A, 202B, and 202C supply the sheets that have been taken out, to the first conveyor path 172.

The printer device 150 is arranged between the detector 100 and the heater 160 along the first conveyor path 172. The printer device 150 includes image forming units 156 of respective colors, a transfer unit, and the like. The image forming units 156 of the respective colors are units for the normal toners of 4 colors of Y, M, C, and K described above and a unit for the erasing toner of blue. The image forming units 156 of the respective colors respectively include photoreceptors for the respective colors and process units such as developing devices arranged around the photoreceptors. Using the toners, the developing devices develop an electrostatic latent image on the photoreceptors to form a toner image on the photoreceptors. The transfer unit includes a transfer belt 154, transfer rollers 152, and the like. The transfer belt 154 supports a toner image primarily transferred from the photoreceptors and runs endlessly. The transfer rollers 152 transfer the toner image supported by the transfer belt 154 onto a sheet from the transfer belt 154 to form an image (toner image) on the sheet.

The conveyor device 170 includes supply rollers 173A, 173B, and 173C, conveyor rollers 175, and resist rollers 176. The supply rollers 173A, 173B, and 173C respectively convey the sheets taken out by the pickup rollers 202A, 202B, and 202C to the resist rollers 176 via the first conveyor path 172. The resist rollers 176 convey the sheets to the transfer rollers 152 in accordance with a transfer timing of the transfer rollers 152.

The second conveyor path 174 branches from the first conveyor path 172 at a branch point 180 positioned more on a downstream side of the first conveyor path 172 than the heater 160. Furthermore, the second conveyor path 174 joins the first conveyor path 172 at a confluence 181 positioned more on an upstream side of the first conveyor path 172 than the heater 160. In other words, the first conveyor path 172 and the second conveyor path 174 form a circulating conveyor path via the branch point 180 and the confluence 181. The second conveyor path conveys a sheet conveyed from the heater 160 to a position right before the resist rollers 176 (confluence 181) again after an inversion operation by a switchback. The second conveyor path 174 is a conveyor path used when forming an image on a back surface of a sheet. Further, the second conveyor path 174 is a conveyor path used when carrying out second erasing processing on a sheet on which an image is formed. It should be noted that details of the erasing processing will be given later.

A path switcher 177 is arranged at the branch point 180. The path switcher 177 sorts the sheets conveyed from the heater 160 into discharge rollers 179 or the second conveyor path 174. The path switcher 177 is controlled such that the sheets are conveyed to the discharge rollers 179 in a normal state (undriven state), for example. On the other hand, in a driven state, the path switcher 177 is controlled such that the sheets are conveyed to the second conveyor path 174 after the switchback as will be described later.

Next, the inversion operation of inverting front and back of a sheet by the switchback of the sheet will be described. The sheet conveyed from the heater 160 is further conveyed to the discharge rollers 179 to be gripped by the discharge rollers 179. Here, by the controller 110 inversely rotating the discharge rollers 179 (switchback) and controlling the path switcher 177 to be in the driven state, the sheet is conveyed to the second conveyor path 174 at the branch point 180. After that, the sheet is conveyed through the second conveyor path 174 so as to be conveyed to the confluence 181 in a front/back-inverted state.

The discharge rollers 179 discharge the sheet to a sheet holding tray 210.

Next, control of the erasing processing will be described. The image forming apparatus 1 of this embodiment determines control of the erasing processing based on which surface of a sheet to be subjected to the erasing processing an image is formed on.

First, the controller 110 determines which surface of a sheet to be subjected to the erasing processing an image is formed on based on image data output from the detector 100. Specifically, based on the image data, the controller 110 determines whether an area ratio of an area where an image is formed with respect to the entire sheet (hereinafter, referred to as printing rate) is a predetermined ratio or more. For example, the controller 110 compares the printing rate of the sheet with a threshold printing rate stored in the ROM 116, to determine whether the printing rate of the sheet is a predetermined ratio (threshold printing rate) or more. If the printing rate is the predetermined ratio or more, the controller 110 determines that an image is formed on that surface. The controller 110 determines whether an image is formed on each of both surfaces of the sheet using the image data obtained from the CCDs 102 and 104.

It should be noted that sheets to be subjected to the erasing processing are categorized into the following 4 patterns based on the determination result obtained by the controller 110.

(A) An image is formed only on a front surface of a sheet.

(B) An image is formed only on a back surface of a sheet.

(C) Images are formed on both surfaces of a sheet.

(D) No image is formed on both surfaces of a sheet.

The image forming apparatus 1 of this embodiment changes control of the conveyor device 170 and the heater 160 in accordance with the 4 patterns of (A) to (D) above.

First, the controller 110 changes control of the conveyor device 170 between a case where the sheet to be subjected to the erasing processing is a sheet of the pattern (A) or (D) above (first sheet) and a case where the sheet is a sheet of the pattern (B) or (C) above (second sheet).

In a case where the sheet is the first sheet, the controller 110 controls the conveyor device 170 to discharge the sheet after passing through the heater 160 once. In other words, the heater 160 executes the erasing processing on the first sheet once. Meanwhile, in a case where the sheet is the second sheet, the controller 110 controls the conveyor device 170 to cause, after the sheet passes through the heater 160 once, the sheet to pass through the heater 160 again via the second conveyor path 174 and discharges the sheet after that. In other words, the heater 160 executes the erasing processing twice on the second sheet.

Further, the controller 110 changes control of the heater 160 during the erasing processing according to the patterns of (A) to (D) above.

In the case of the pattern (A) above, the controller 110 executes the erasing processing while controlling a temperature of the heater 160 at a temperature A.

It should be noted that the temperature A is a temperature at which an image formed on a front surface of a sheet can be erased.

In the case of the pattern (B) above, the controller 110 controls the temperature of the heater 160 to be a temperature B1 during first erasing processing and controls the temperature of the heater 160 to be a temperature B2 higher than the temperature B1 during second erasing processing.

It should be noted that the temperature B2 is a temperature at which an image formed on a back surface of a sheet can be erased. The temperature B2 is a temperature similar to the temperature A, but since the sheet is already heated by the heater 160 controlled at the temperature B1 when the sheet passes it the first time, the temperature B2 may be set to be lower than the temperature A.

Further, the temperature B1 may take any value as long as it is lower than the temperature B2. The temperature B1 may be a temperature during standby, that is, a temperature in a state where the heater 160 is not energized, for example. Moreover, the temperature B1 may be a temperature obtained in midst of a process where the temperature of the heater 160 is raised by the controller 110 (warmup operation), for example.

In the case of the pattern (C) above, the controller 110 controls the temperature of the heater 160 to be a temperature C1 during the first erasing processing. Furthermore, during the second erasing processing, the controller 110 controls the temperature of the heater 160 to be a temperature C2 lower than the temperature C1 during the first sheet passing.

It should be noted that similar to the temperature A, the temperature C1 is a temperature at which an image formed on a front surface of a sheet can be erased. Further, the temperature C2 is a temperature at which an image formed on a back surface of a sheet can be erased during the second erasing processing. At the time of the second erasing processing, heat is already applied to the sheet by the heater 160 in the first erasing processing. Due to this applied heat, the temperature C2 is set to be lower than the temperature C1.

In the case of the pattern (D) above, the controller 110 controls the temperature of the heater 160 to be a temperature D lower than that in the case of the pattern (A) above.

It should be noted that the temperature D may be a temperature during standby, that is, a temperature in a state where the heater 160 is not energized, for example. Moreover, the temperature D may be a temperature obtained in midst of a process where the temperature of the heater 160 is raised by the controller 110 (warmup operation).

Furthermore, in the case of the second sheet, a sum of heat amounts applied to the sheet in the second erasing processing does not change, so the temperatures B1 and B2 and the temperatures C1 and C2 may be exchanged with each other. Specifically, in the case of the pattern (B) above, for example, the controller 110 controls the temperature of the heater 160 to be the temperature B2 during the first erasing processing. Further, the controller 110 controls the temperature of the heater 160 to be the temperature B1 lower than the temperature B2 during the second erasing processing.

Figure 3:
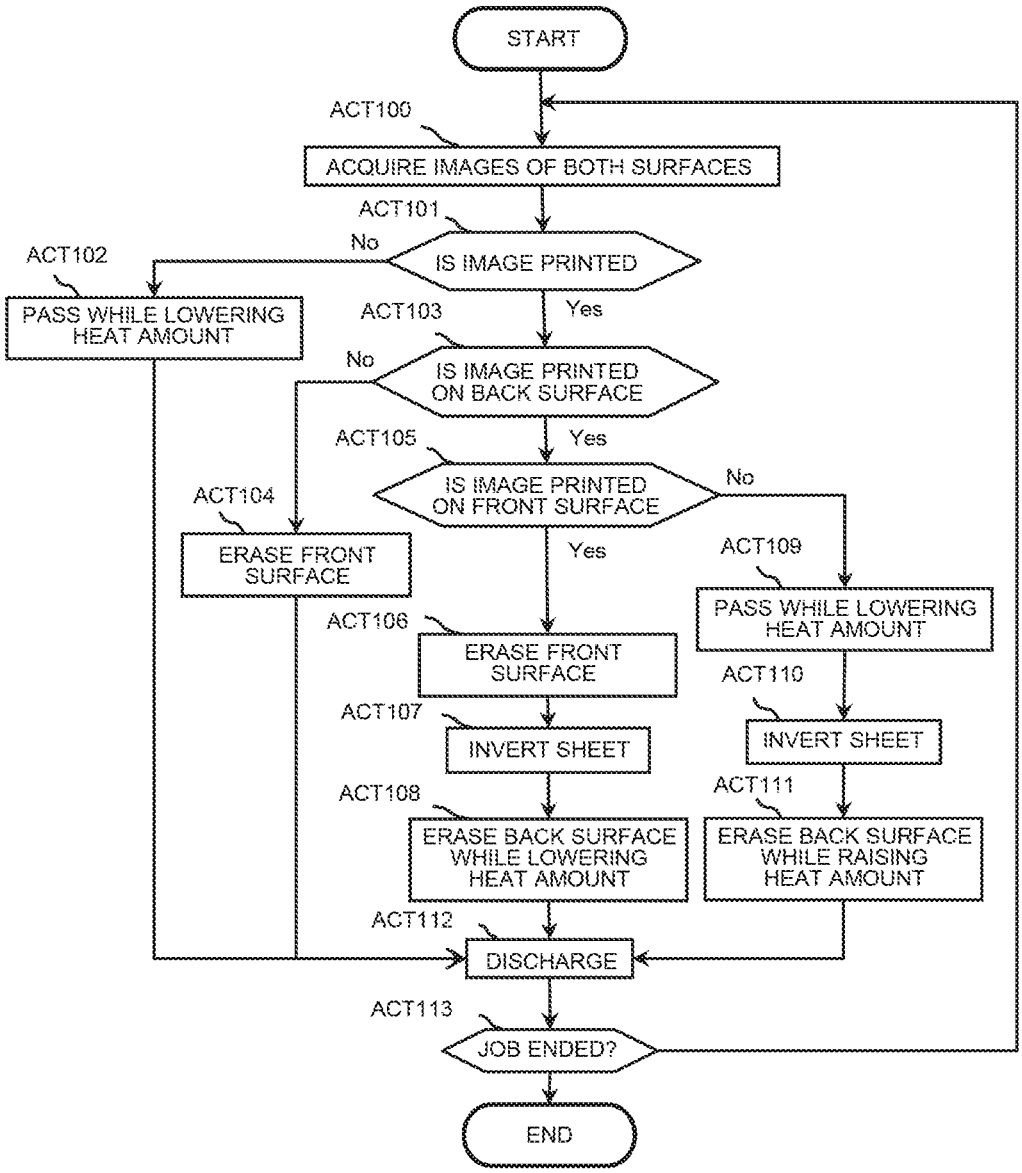
FIG. 3 is a flowchart showing control processing of the image processing apparatus according to the first embodiment.

The respective control described above carried out by the controller 110 will be described below using a flowchart of FIG. 3. It should be noted that in descriptions below, a state where an image is formed on a sheet may be expressed as image being printed on a sheet.

The controller 110 acquires an erasing job execution request from a user via the control panel 140, for example. The controller 110 starts energizing the heater 160 as a warmup operation for raising the temperature of the heater 160 to a temperature at which the erasing processing can be executed (e.g., temperature A). After that, the controller 110 drives the pickup roller 202A of the sheet feeder cassette 200A, for example, to supply a sheet accommodated in the sheet feeder cassette 200A. The controller 110 supplies the supplied sheet to the first conveyor path 172 by the supply rollers 173A. Next, the detector 100 reads images on both surfaces of the sheet and outputs image data of the both surfaces of the sheet to the controller 110. In other words, the controller 110 acquires the images on both surfaces of the sheet using the detector 100 (ACT 100). The controller 110 determines whether an image is formed on both surfaces of the sheet based on the image data on the both surfaces of the sheet output from the detector 100 (ACT 101).

In a case of determining that an image is not printed on either surface of the sheet based on the detection result of the detector 100, that is, the sheet reading result (image data of sheet) obtained by the detector 100 (No in ACT 101), the controller 110 stops energizing the heater 160 so as to stop the heating of the sheet by the heater 160. Specifically, the controller 110 stops energizing the heater 160 to lower the heat amount to be applied to the sheet (ACT 102). The controller 110 controls the conveyor device 170 to convey the sheet along the first conveyor path 172 and discharge it in the sheet holding tray 210 (ACT 112). The controller 110 determines whether there is a sheet in the sheet feeder cassette 200A, and when there is no sheet, ends the job (Yes in ACT 113) and ends the series of control. When there is a sheet in the sheet feeder cassette 200A, the controller 110 continues the erasing job (No in ACT 113) and returns to the processing of ACT 100.

On the other hand, in a case of determining that an image is printed on the sheet (Yes in ACT 101), the controller 110 determines whether an image is printed on a back surface of the sheet (ACT 103). In a case of determining that an image is not printed on the back surface of the sheet (No in ACT 103), that is, an image is printed only on the front surface of the sheet, the controller 110 conveys the sheet to the heater 160 by the conveyor device 170. The heater 160 is controlled at the temperature A by the controller 110 and erases the image on the front surface of the conveyed sheet (ACT 104). The controller 110 controls the conveyor device 170 to convey the sheet subjected to erasing processing along the first conveyor path 172 and discharge it in the sheet holding tray 210 (ACT 112).

Next, in a case of determining that an image is formed on the back surface of the sheet (Yes in ACT 103), the controller 110 determines whether an image is also printed on the front surface of the sheet (ACT 105). In a case of determining that the image is also printed on the front surface of the sheet (Yes in ACT 105), that is, images are printed on both surfaces of the sheet, the controller 110 conveys the sheet to the heater 160 by the conveyor device 170. The heater 160 is controlled at the temperature Cl by the controller 110 and erases the image on the front surface of the conveyed sheet (ACT 106). After that, the controller 110 controls the conveyor device 170 and the path switcher 177. The sheet conveyed along the first conveyor path 172 is conveyed through the second conveyor path 174 and then conveyed again along the first conveyor path 172 in an inverted state (ACT 107). The heater 160 is controlled at the temperature C2 by the controller 110 and erases the image on the back surface of the sheet conveyed again from the confluence 180 (ACT 108). It should be noted that in the second erasing processing, the controller 110 sets the energization amount of the heater 160 to be lower than that in the first erasing processing. In other words, the controller 110 sets the heat amount to be applied to the sheet during the second erasing processing to be lower than that of the first erasing processing. After that, the controller 110 conveys the sheet along the first conveyor path 172 and discharges it in the sheet holding tray 210 (ACT 112).

In a case where an image is printed only on the back surface of the sheet (No in ACT 105), the conveyor device 170 causes the sheet to pass through the heater 160. At this time, the controller 110 does not energize the heater 160 so that the heat amount is lowered (ACT 109). After that, the controller 110 controls the conveyor device 170 and the path switcher 177. The sheet conveyed along the first conveyor path 172 is conveyed through the second conveyor path 174 and then conveyed again along the first conveyor path 172 in an inverted state (ACT 110).

The heater 160 is controlled at the temperature B2 by the controller 110 and erases the image on the back surface of the sheet conveyed again from the confluence 180 (ACT 111). In this second erasing processing, the controller 110 sets the energization amount of the heater 160 to be higher than that in the first erasing processing. In other words, the controller 110 sets the heat amount to be applied to the sheet during the second erasing processing to be higher than that of the first erasing processing. After that, the controller 110 controls the conveyor device 170 to convey the sheet along the first conveyor path 172 and discharge it in the sheet holding tray 210 (ACT 112).

As the sheet is discharged in the sheet holding tray 210, the controller 110 determines whether the erasing job has ended (ACT 113). The controller 110 determines whether the erasing job has ended based on whether there is a sheet in the sheet feeder cassette 200A. In a case where the erasing job has ended (Yes in ACT 113), the controller 110 ends the series of control. In a case where the erasing job has not ended (No in ACT 113), the controller 110 returns to the processing of ACT 100. It should be noted that although the controller 110 determines whether the erasing job has ended after the sheet is discharged in the processing flow above, it is also possible to determine whether the erasing job has ended before the sheet is discharged. In this case, the controller 110 determines whether the erasing job has ended upon discharge of the sheet.

As described above, by controlling the conveyance paths and temperature of the heater according to the sheet reading result of the detector 100, a processing time and power consumption of the image forming apparatus 1 of this embodiment can be optimized.

It should be noted that although the heat amount to be applied to the sheet in the erasing processing is controlled by controlling the temperature of the heating roller 162 in this embodiment, the heat amount may be controlled by a sheet conveyance velocity. For example, when increasing the heat amount to be applied to the sheet, the controller 110 controls the conveyor device 170 to cause the sheet to pass through the heater 160 at a low conveyance velocity. On other hand, when lowering the heat amount to be applied to the sheet, the controller 110 controls the conveyor device 170 to cause the sheet to pass through the heater 160 at a high conveyance velocity.

Second Embodiment

In this embodiment, an erasing apparatus will be described as an example of the image processing apparatus.

Figure 4:
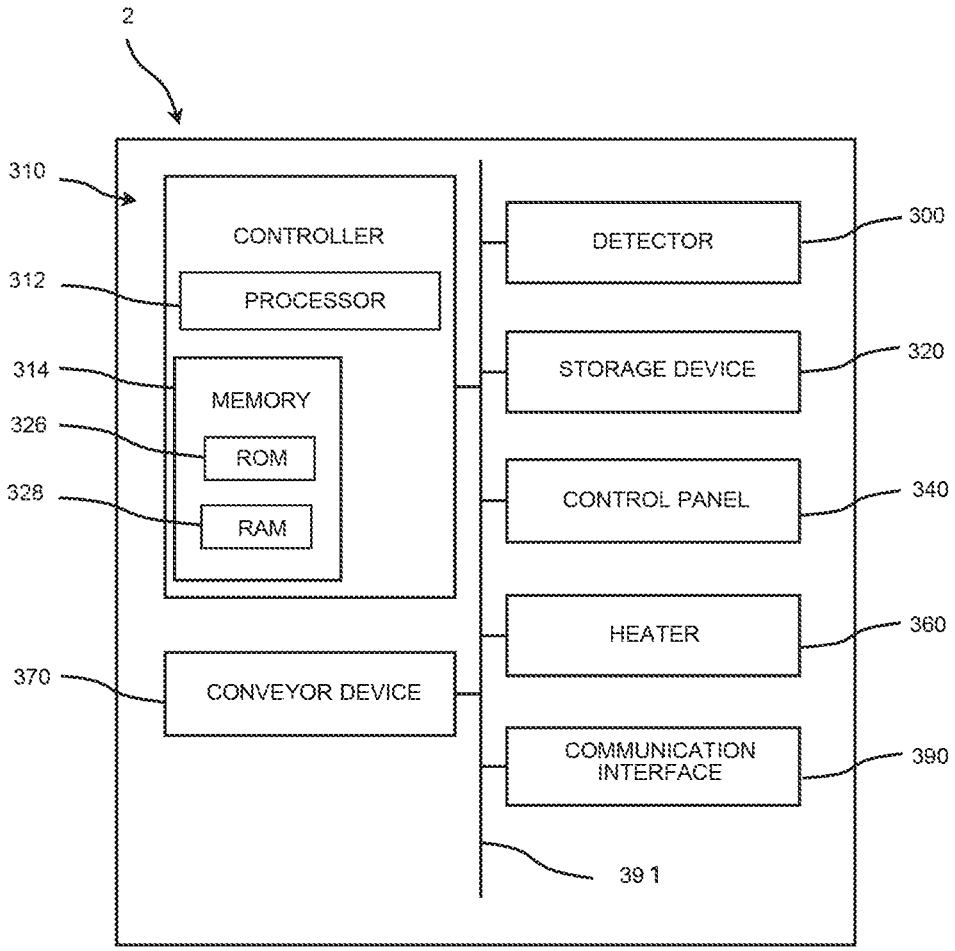
FIG. 4 is a block diagram showing an image processing apparatus according to a second embodiment.

FIG. 4 is a control block diagram showing a hardware configuration of an erasing apparatus 2.

The erasing apparatus 2 includes a detector 300, a controller 310, a storage device 320, a control panel 340, a heater 360 for erasing, a conveyor device 370, and a communication interface (I/F) 390. The respective units of the erasing apparatus 2 are connected to one another via a bus line 391.

It should be noted that the detector 300, the controller 310, the storage device 320, the control panel 340, the conveyor device 370, and the communication interface (I/F) 390 have configurations similar to those of the first embodiment, so descriptions thereof will be omitted.

The heater 360 executes erasing processing by heating a sheet to be subjected to the erasing processing. A specific configuration will be described with reference to FIG. 5.

The erasing apparatus 2 includes a function of erasing a sheet on which an image is formed. Erasing used herein means visually making an image formed in colors different from a base color of a sheet (including not only chromatic colors but also achromatic colors such as white and black) disappear.

Figure 5:
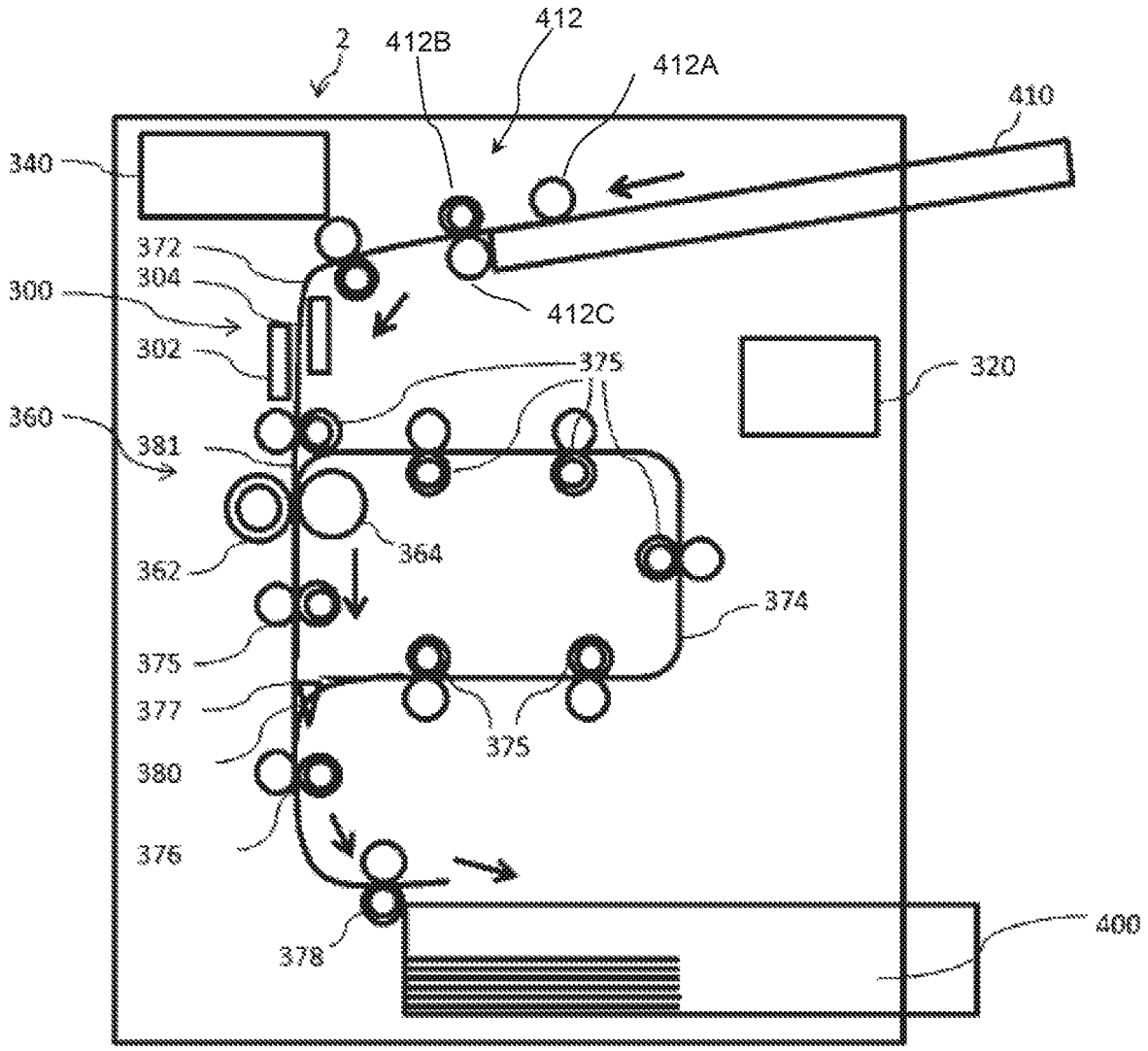
FIG. 5 is a cross-sectional diagram showing the image processing apparatus according to the second embodiment.

FIG. 5 is a cross-sectional diagram of the erasing apparatus 2 shown in FIG. 4.

The erasing apparatus 2 includes a sheet feeder device that supplies sheets. The sheet feeder device includes a sheet feeder tray 410. The sheet feeder tray 410 is provided at an upper portion of a casing. The sheet feeder tray 410 accommodates sheets to be reused. The sheets to be reused are each a sheet on which an image is printed by a recording material such as an erasable toner. It should be noted that the sheets may be of various sizes such as A3, A4, and B5. The sheet feeder device further includes a sheet feeder member 412. The sheet feeder member 412 includes a pickup roller 412A, a supply roller 412B, a separation roller 412C arranged opposite to the supply roller 412B, and the like. The sheet feeder member 412 conveys the sheets on the sheet feeder tray 410 one by one to a first conveyor path 372 inside the erasing apparatus 2.

The first conveyor path 372 of the conveyor device 370 conveys the sheets from the sheet feeder tray 410 to the heater 360. The first conveyor path 372 includes a plurality of conveyor rollers 375 and forms a conveyance path from the sheet feeder tray 410 to a discharge tray 400 via a confluence 381, the detector 300, the heater 360, and a branch point 380.

The detector 300 is provided on a downstream side of the sheet feeder tray 410 along the first conveyor path 372. The detector 300 includes CCDs 302 and 304 that sandwich the first conveyor path 372. The detector 300 reads images on both surfaces of a conveyed sheet by the CCDs 302 and 304 and outputs image data of the both surfaces of the sheet. The controller 310 determines which surface of the sheet an image is formed on using the image data output from the CCDs 302 and 304.

The heater 360 is provided on a downstream side of the detector 300 along the first conveyor path 372. The heater 360 includes a heating roller 362 and a pressure roller 364. The heating roller 362 applies heat to a sheet from a first surface side of the sheet. The pressure roller 364 applies pressure to the sheet from a second surface side of the sheet. By this heating and pressurization, the heater 360 erases an image on the sheet.

It should be noted that the first surface of a sheet in this embodiment refers to an upper surface (hereinafter, referred to as front surface) of a sheet supported inside the sheet feeder tray 410, and the second surface of a sheet refers to a lower surface (hereinafter, referred to as back surface) of a sheet supported inside the sheet feeder tray 410.

A second conveyor path 374 of the conveyor device 370 branches from the first conveyor path 372 at the branch point 380 positioned more on a downstream side of the first conveyor path 372 than the heater 360. Furthermore, the second conveyor path 374 joins the first conveyor path 372 at a confluence 381 positioned more on an upstream side of the first conveyor path 372 than the heater 360. In other words, the first conveyor path 372 and the second conveyor path 374 form a circulating conveyor path via the branch point 380 and the confluence 381. The second conveyor path 374 conveys a sheet conveyed from the heater 360 to a position right before the heater 360 again after inverting it by a switchback. The second conveyor path 374 is a conveyor path used when carrying out second erasing processing on a sheet on which an image is formed.

A path switcher 377 is arranged at the branch point 380. The path switcher 377 sorts the sheets conveyed from the heater 360 into conveyor rollers 376 or the second conveyor path 374. The path switcher 377 is controlled such that the sheets are conveyed to the conveyor rollers 376 in a normal state (undriven state), for example. On the other hand, in a case where there is a need to invert front and back of a sheet, the path switcher 377 is put to a driven state. The path switcher 377 is controlled such that the sheets switched back (inversely conveyed) by the inverse rotation of the conveyor rollers 376 are conveyed to the second conveyor path 374.

Next, the inversion operation of inverting front and back of a sheet by the switchback of the sheet will be described. The sheet conveyed from the heater 360 is further conveyed to the conveyor rollers 376 to be gripped by the conveyor rollers 376. Here, by the controller 310 inversely rotating the conveyor rollers 376 (switchback) and controlling the path switcher 377 to be in the driven state, the sheet is conveyed to the second conveyor path 374 at the branch point 380. After that, the sheet is conveyed through the second conveyor path 374 so as to be conveyed to the confluence 381 in a front/back-inverted state.

Discharge rollers 378 discharge the sheet to the discharge tray 400.

Next, control of the erasing processing will be described. The erasing apparatus 2 of this embodiment determines control of the erasing processing based on which surface of a sheet to be subjected to the erasing processing an image is formed on.

It should be noted that the determination on which surface of a sheet an image is formed on and control of the erasing processing according to a result of that determination are similar to those of the first embodiment, so descriptions thereof will be omitted.

As described above, by controlling the conveyance paths and temperature of the heater 360 according to the sheet reading result of the detector 300, a processing time and power consumption of the erasing apparatus 2 of this embodiment can be optimized.

It should be noted that although the heat amount to be applied to the sheet in the erasing processing is controlled by controlling the temperature of the heating roller 362 in this embodiment described above, the heat amount may be controlled by a sheet conveyance velocity. For example, when increasing the heat amount to be applied to the sheet, the controller 310 controls the conveyor device 370 to cause the sheet to pass through the heater 360 at a low conveyance velocity. On other hand, when lowering the heat amount to be applied to the sheet, the controller 310 controls the conveyor device 370 to cause the sheet to pass through the heater 360 at a high conveyance velocity.

While certain embodiments have been described, these embodiments have been presented by way of example only, and are not intended to limit the scope of the inventions. Indeed, the novel methods and systems described herein may be embodied in a variety of the other forms; furthermore, various omissions, substitutions and changes in the form the methods and systems described herein may be made without departing from the spirit of the inventions. The accompanying claims and their equivalents are intended to cover such forms or modifications as would fall within the scope and spirit of the inventions.

What is claimed is:

1. An image processing apparatus, comprising:

a detector that detects images formed on a first surface of a sheet or a second surface of the sheet opposite the first surface;

a heater that applies a predetermined heat amount to the sheet from a first surface side of the sheet to carry out erasing processing for erasing images formed on the sheet;

a conveyor device that conveys the sheet to the heater; and a controller configured to:

determine which of the first and second surfaces has an image formed thereon on the basis of a detection result from the detector, when the controller determines that only the first surface has an image formed thereon, control the conveyor device to convey the sheet to the heater and control the heater to apply a first heating amount to the sheet, and when the controller determines that the second surface has an image formed thereon, control the conveyor device to convey the sheet to the heater and the heater to apply a second heating amount to sheet, and after the sheet passes through the heater, control the conveyor device to return the sheet to the heater and control the heater to apply a third heating amount to the sheet.

2. The image processing apparatus according to claim 1, wherein the second heating amount is different from the first heating amount.

3. The image processing apparatus according to claim 2, wherein the second heating amount is less than the first heating amount.

4. The image processing apparatus according to claim 1, wherein the controller controls heating amounts by changing a heating temperature of the heater.

5. The image processing apparatus according to claim 1, wherein the detector reads a surface of the sheet and outputs image data to the controller as a reading result, and the controller determines a printing rate of the sheet based on the image data output from the detector and determines whether images are formed on the sheet based on the determined printing rate.

6. The image processing apparatus according to claim 1, wherein the conveyor device includes:

a first conveyor path for conveying sheets through the heater, and a second conveyor path for conveying sheets from a branch point on a downstream side of the heater to a confluence point, with respect to the first conveyor path, on an upstream side of the heater.

7. The image processing apparatus according to claim 6, wherein the controller controls the conveyor device such that the sheet is conveyed from the branch point via the second conveyor path to the confluence point in a state where front and back of the sheet is inverted when determined that an image is formed on the second surface of the sheet.

8. An image processing method, comprising:

detecting images formed on a first surface of a sheet or a second surface of the sheet opposite the first surface;

determining, based on a result of the detection, which of the first and second surfaces has an image formed thereon;

when only the first surface is detected as having an image formed thereon, conveying the sheet to a heater and applying a first heating amount to the sheet via the heater, and when the second surface is detected as having an image formed thereon, conveying the sheet to the heater and applying a second heating amount to sheet via the heater, and after the sheet passes through the heater, returning the sheet to the heater and applying a third heating amount to the sheet via the heater.

9. The method according to claim 8, wherein the first heating amount erases the image on the first surface of the sheet, the second heating amount is less than or equal to first heating amount, and the third heating amount is different from the second heating amount.

10. The method according to claim 8, wherein the first heating amount erases the image on the first surface of the sheet, and the second heating amount and the third heating amount are different form the first heating amount.

11. The method according to claim 8, wherein the third heating amount is less than the second heating amount.

12. The image processing apparatus according to claim 1, wherein the first heating amount erases the image on the first surface of the sheet, the second heating amount is less than or equal to first heating amount, and the third heating amount is different from the second heating amount.

13. The image processing apparatus according to claim 1, wherein the first heating amount erases the image on the first surface of the sheet, and the second heating amount and the third heating amount are different form the first heating amount.

14. The image processing apparatus according to claim 1, wherein the third heating amount is less than the second heating amount.

* * * * *